US006851230B2

(12) United States Patent
Breslin et al.

(10) Patent No.: US 6,851,230 B2
(45) Date of Patent: Feb. 8, 2005

(54) PADDING DEVICE FROM AN ABOVE-GROUND POOL AND ITS ASSOCIATED METHOD OF INSTALLATION

(76) Inventors: Marianne Breslin, 6205 Erdrick St., Philadelphia, PA (US) 19135; John J. Policastro, 6635 Tackawanna St., Philadelphia, PA (US) 19135

( * ) Notice: Subject to any disclaimer, the term of this patent is extended or adjusted under 35 U.S.C. 154(b) by 55 days.

(21) Appl. No.: 10/042,857

(22) Filed: Jan. 11, 2002

(65) Prior Publication Data

US 2003/0131556 A1 Jul. 17, 2003

(51) Int. Cl.[7] ..... E04H 4/00; E04H 4/14

(52) U.S. Cl. ..... 52/169.7; 52/745.15; 4/488; 4/495; 4/496; 4/501; 4/502; 4/503; 4/513

(58) Field of Search ..... 52/169.7, 741.1, 52/745.02, 745.01, 745.15, 745.19, 850, 169.8, 748.1; 4/495, 496, 501, 502, 503, 513, 488

(56) References Cited

U.S. PATENT DOCUMENTS

| | | | | | |
|---|---|---|---|---|---|
| 3,644,942 | A | * | 2/1972 | Haight | 4/506 |
| 3,934,277 | A | * | 1/1976 | Quirouette et al. | 52/245 |
| 4,284,059 | A | * | 8/1981 | Thomason | 126/564 |
| 5,398,351 | A | * | 3/1995 | Watson | 4/506 |
| 5,813,946 | A | * | 9/1998 | Lin et al. | 482/27 |
| 5,924,144 | A | * | 7/1999 | Peterson | 4/488 |
| 6,071,213 | A | * | 6/2000 | Raasch et al. | 482/29 |

* cited by examiner

*Primary Examiner*—Jeanette E. Chapman
(74) *Attorney, Agent, or Firm*—LaMorte & Associates

(57) ABSTRACT

A prefabricated pad for a pool and its associated method of installation under the liner of an above-ground pool. The prefabricated pad is interposed between the ground surface and the pool liner, wherein the prefabricated pad cushions the pool liner, reduces contact stresses against the pool liner and prevents the pool liner from being punctured by any object present below the pool. The prefabricated pad also supports the pool liner as the pool liner turns from the vertical walls of the pool to the flat bottom of the pool.

8 Claims, 3 Drawing Sheets

PADDING DEVICE FROM AN ABOVE-GROUND POOL AND ITS ASSOCIATED METHOD OF INSTALLATION

BACKGROUND OF THE INVENTION

1. Field of the Invention

The present invention relates to the structure of above-ground swimming pools and the methods in which above-ground swimming pools are installed. More particularly, the present invention relates to the preparation of the grounds on which an above-ground pool is placed when installed.

2. Prior Art Statement

The prior art is replete with different types and styles of above-ground swimming pools. Above-ground swimming pools are pools that contain a framework that is assembled on top of the ground or another exterior surface. A waterproof liner is then placed in the framework and the liner is filled with water to create the pool.

Above-ground swimming pools are popular for many reasons. One reason above-ground pools are so popular is that above-ground pools are temporary and do not require the excavation of land, as would a permanent in-ground pool. Accordingly, a person can assemble an above-ground pool and keep it for one summer season, or for many years. Once the pool is no longer desired, it can easily be dismantled and stored.

Another reason above-ground pools are so popular is that they are very inexpensive as compared to the cost of permanent in-ground pools. For many homeowners who want a private pool but cannot afford a permanent in-ground pool, above-ground pools are the only option.

A third reason above-ground pools are so poplar is that they do not require any permanently built structure. As such, many municipalities do not require building permits for the installation of above-ground pools. Furthermore, many homeowners are prevented from building in-ground pools because of local zoning ordinances. Such homeowners also have no choice but to use an above-ground pool, if they desire their own private pool.

Since above-ground pools are popular among a wide range of people, above-ground pools are manufactured in a wide range of shapes, styles and depths to accommodates the needs and tastes of that wide range of people. However, regardless of the shape, style or depth of the pool, the basic construction of an above-ground pool remains the same. Traditional above-ground pools have a framework that supports a continuous vertical wall. It is this continuous vertical wall that serves as the periphery of the above-ground pool. Once the continuous vertical wall is in place, the interior of the area that is surrounded by the vertical wall is lined with a pool liner. The pool liner is draped across the area defined by the continuous vertical wall so that the pool liner covers the ground within the limits of the vertical wall and covers the interior surface of the peripheral wall. It is the pool liner that retains water within the space defined by the continuous vertical wall. The continuous vertical wall merely supports the edges of the pool liner. Once the liner is secured in place, the pool liner is filled with water and the pool is complete.

There are disadvantages to the design of above-ground pools. Pool liners are thin and flexible. If the liner tears at any point, water will leak from the pool until the water level in the pool reaches the level of the tear. Pool liners are flat sections of waterproof material that are draped across an above-ground pool. Since the pool liner is manufactured as a flat sheet, the pool liner often buckles and folds as is conforms to the shape of the pool. As people in the pool walk around the pool, or as the pool is cleaned with various equipment, these folds wear from contact and often begin to leak over time. As such, the pool must be periodically drained and the pool liner replaced or repaired.

One factor that greatly effects the wearing of pool liners, is the condition of the ground surface below the pool liner. If an above-ground pool is constructed over hard concrete, the pool liner wears rapidly as the pool liner chafes against the concrete. If the above-ground pools is constructed over rocky soil or rooted soil, the rocks and roots can puncture the pool liner or create bulges on the pool liner that wear quickly. Even above-ground pools constructed over rock free soil may encounter rocks over time. As the weight of a filled pool presses upon the ground, the soil compacts. Rocks buried below the ground may then become present on the surface of the ground, where the rock contacts the pool liner. Lastly, if an above-ground pool is constructed over a wooden deck, the liner bulges in the spaces between the planks. The bulges eventually tear, thereby requiring that the pool liner be replaced.

According to the manufacturer's instructions, one of the best surfaces to construct an above-ground pool on is soft granular sand. The sand supports the pool liner at all points and evenly distributes stresses experienced by the pool liner. It is for this reason that many people place sand on the ground before assembling their aboveground pools. Although sand is a recommended surface, it also has its disadvantages. Sand does not stop roots from growing up under a pool. Furthermore, over time, sand tends to become intermixed with the topsoil and obtains the properties of topsoil rather than that of granular sand. Another disadvantage of sand is that it is very heavy. Large above-ground pools may require thousands of pounds of sand to properly prepare the ground below the pool liner. It takes a great deal of time and labor to transport and spread that amount of sand. Lastly, sand flows. As such, sand cannot be used on wooden decks that have spaces between the planks, else the sand will flow through the spaces between the planks. Accordingly, sand cannot be used under small children's pools that are often placed on decks or wooden patios.

A need therefore exists for a new device that can be placed under a pool liner that replaces the use of sand but does not have the disadvantages of sand. This need is met by the present invention as described and claimed below.

SUMMARY OF THE INVENTION

The present invention is a prefabricated pad for a pool and its associated method of installation under the liner of an above-ground pool. The prefabricated pad is interposed between the ground surface and the pool liner, wherein the prefabricated pad cushions the pool liner, reduces contact stresses against the pool liner and prevents the pool liner from being punctured by any object present below the pool. The prefabricated pad also supports the pool liner as the pool liner turns from the vertical walls of the pool to the flat bottom of the pool.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention pool liner pad can be configured in many different shapes to fit many differently shaped above-ground swimming pools, the present invention pool liner pad is presented as a circular pad for use with a traditional circular aboveground pool. Such a configuration is merely exemplary and it should be understood that the present invention pool liner pad can also be used with square pools, oval pools, peanut-shaped pools and other non-tradition above-ground pool shapes.

Figure 1:
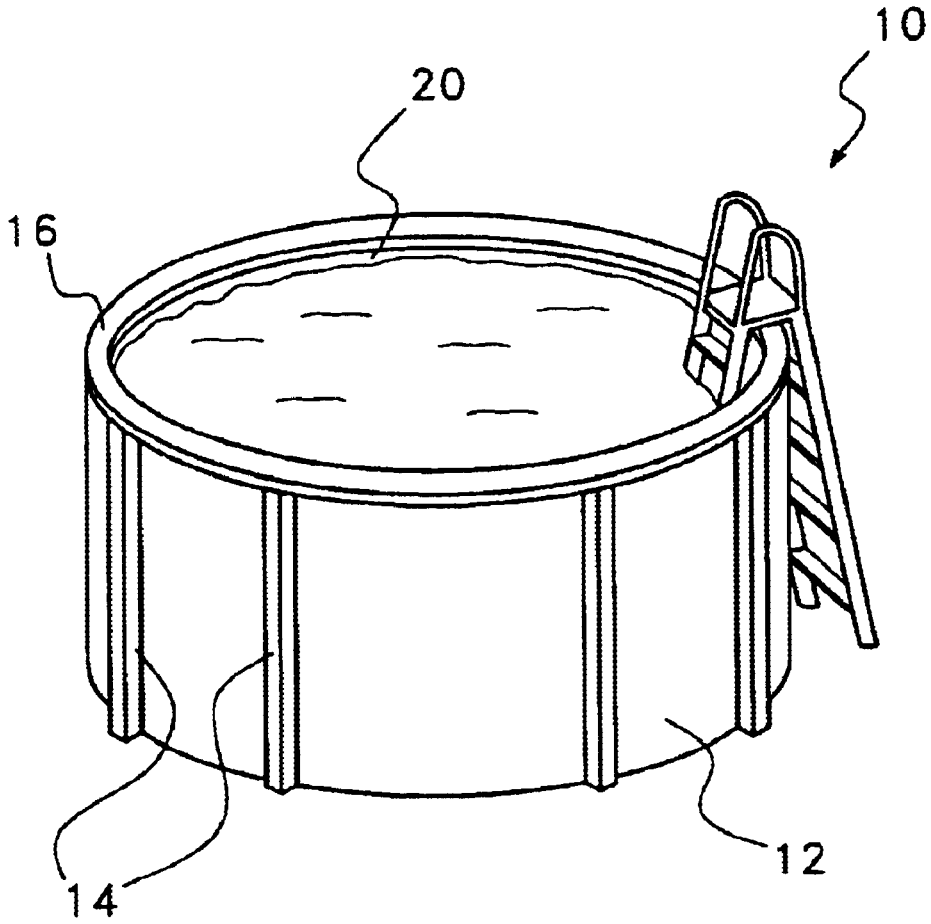
FIG. 1 is a perspective view of an above-ground swimming pool.

Referring to FIG. 1, there is shown a traditional circular above-ground pool 10. The above-ground pool is constructed from a continuous wall 12 of sheet metal that is supported in a vertical orientation by a plurality of support beams 14. The top of the vertical wall 12 is covered with a flat coping 16. A pool liner 20 is draped across the pool 10. The pool liner 20 is made from a flexible water-impervious material. The pool liner 20 overlaps the top of the continuous wall 12, below the coping 16. As such, the pool liner 20 covers the interior surface of the continuous wall 12 as well as the area of ground contained within the continuous wall 12.

Figure 2:
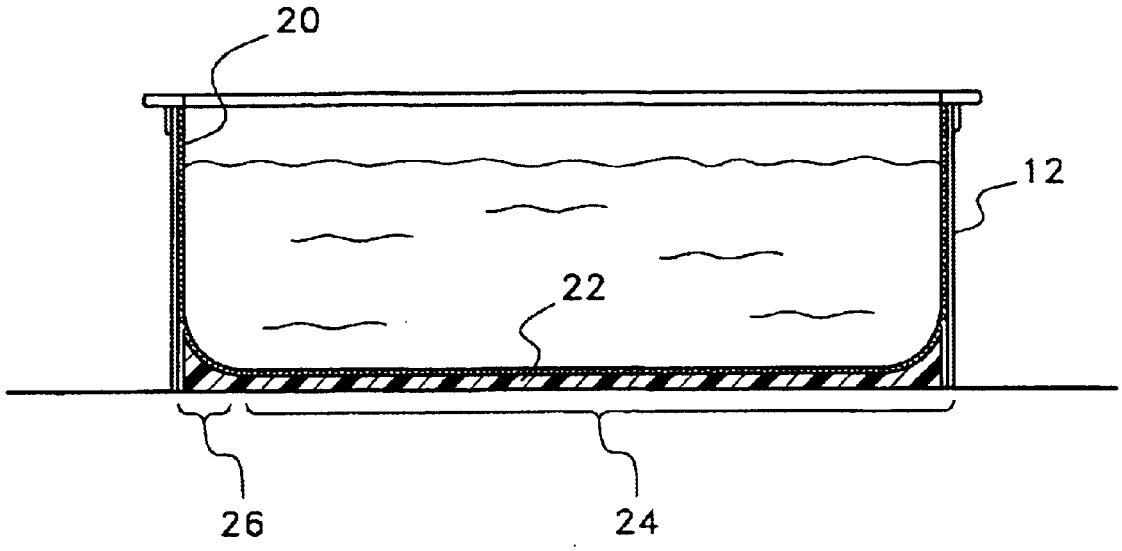
FIG. 2 is a cross-sectional view of the above-ground swimming pool shown in FIG. 1.

Referring to FIG. 2, it can be seen that a pool liner pad 22 is provided. The pool liner pad 22 has the same peripheral shape, as does the continuous wall 12 of the pool 10. Accordingly, when the pool liner pad 22 is placed on the ground within the confines of the continuous wall 12, the exterior edge of the pool liner pad 22 abuts against the interior of the continuous wall 12 at all points.

The pool liner pad 22 is made from a soft, tear resistant, hydrophobic material. Most synthetic elastomeric materials are hydrophobic, accordingly many elastomeric materials are appropriate for the pool liner pad 22. However, many elastomeric materials are dense and thus would be heavy. Accordingly, the pool liner pad 22 is preferably made from a closed cell foam material, such as polypropylene foam, a polyurethane foam or a polyvinyl chloride foam. A closed cell foam is preferred over an open cell foam, to prevent the pool liner pad 22 from retaining water like a sponge.

The central region 24 of the pool liner pad 22 has a consistent thickness and is preferably between ½ inch and 4 inches thick depending upon the density of the material used. Thicker pads are used with less dense material since this material becomes greatly compressed when placed under the weight of the pool's water. However, in the shown embodiment, the pool liner pad 22 is not uniform in thickness. Rather, the area 26 of the pool liner pad 22 near its peripheral edge 28 is much thicker than is the central region 24. The thick peripheral region 26 quickly tapers to the thickness of the central region 24. As can be seen in FIG. 2, the thick peripheral region 26 of the pool liner pad 22 is the portion of the pool liner pad 22 that abuts against the continuous wall 12 of the pool. As the pool liner 20 curves from covering the vertical continuous wall 12 to covering the horizontal pool liner pad 22, a natural gap occurs at the point of transition. By providing the thick peripheral region 26 on the pool liner pad 22, the thick peripheral region 26 fills the gap at the point of transition and fully supports the pool liner 20 as the pool liner 20 curves from the vertical continuous wall 12 to the horizontal bottom of the pool 10.

The presence of the pool liner pad 22 under the pool liner 20 at the bottom of the pool 10, provides a soft surface against the pool liner 20 that will not chafe the pool liner 20. Furthermore, the pool liner pad 22 distributes stress applied either to the pool liner 20 or to the pool liner pad 22. For example, if a root were to grow under the pool liner pad 22, the pool liner pad 22 would deform against the root without allowing the root to cause an isolated bulge in the pool liner 20. The presence of the pool liner pad 22 also assists in preventing the pool liner pad 22 from being torn from below, since any sharp object present under the pool would first have to tear through the tough material of the pool liner pad 22 before that object could contact the pool liner 20.

Figure 3:
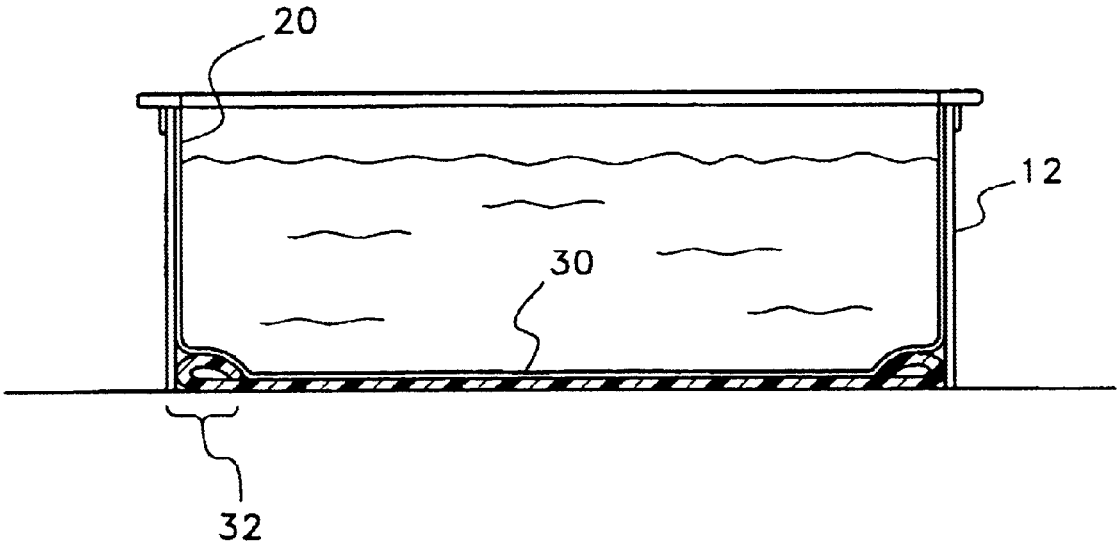
FIG. 3 is a cross-sectional view of an above-ground swimming pool having an alternate embodiment of a pool liner pad.

Referring to FIG. 3, an alternative embodiment of the present invention pool lining pad 30 is shown. In this embodiment, the pool lining pad 30 does not contain a thick peripheral region. Rather, a pool liner pad 30 having a diameter larger than that of the pool is used. The pool liner pad 30 is then folded over at its edge until the pool liner pad 30 is the same diameter as is the pool. By folding over the edge of the pool liner pad 30, a thickened peripheral region 32 is created. This thickened peripheral region 32 supports the pool liner 20 as it turns from the continuous wall 12 of the pool to the horizontal bottom of the pool.

Figure 4:
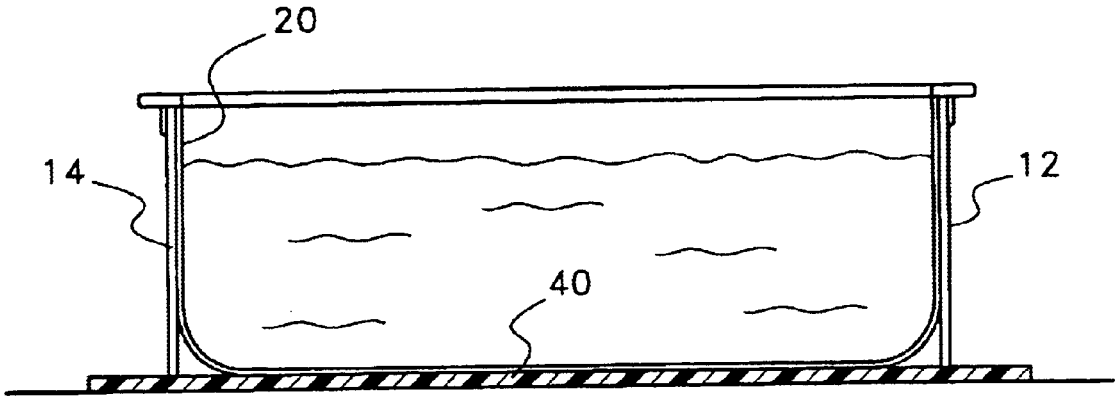
FIG. 4 is a cross-sectional view of an above-ground swimming pool having an alternate embodiment of a pool liner pad.

Referring to FIG. 4 another embodiment of the present invention pool liner pad 40 is shown. In this embodiment, the pool liner pad 40 is a flat pad of uniform thickness. The pool liner pad 40 can have the same shape as does the pool. However, in the shown embodiment, the pool liner pad 40 is larger than is the pool and this extends beyond the continuous wall 12 of the pool. Accordingly, the continuous wall 12 of the pool and the wall supports 14 of the pool are assembled over the pool liner pad 40. This is useful if the pool is being assembled on a slotted surface, such as a deck. It is also useful when assembling a pool on the ground, because the pool liner pad 40 prevents weeds and other plants from growing directly against the exterior of the pool. By preventing growth surrounding the pool, the pool liner pad 40 prevents roots from growing directly under the pool and prevents the pool owner from having to weed directly against the side of the pool.

Figure 5:
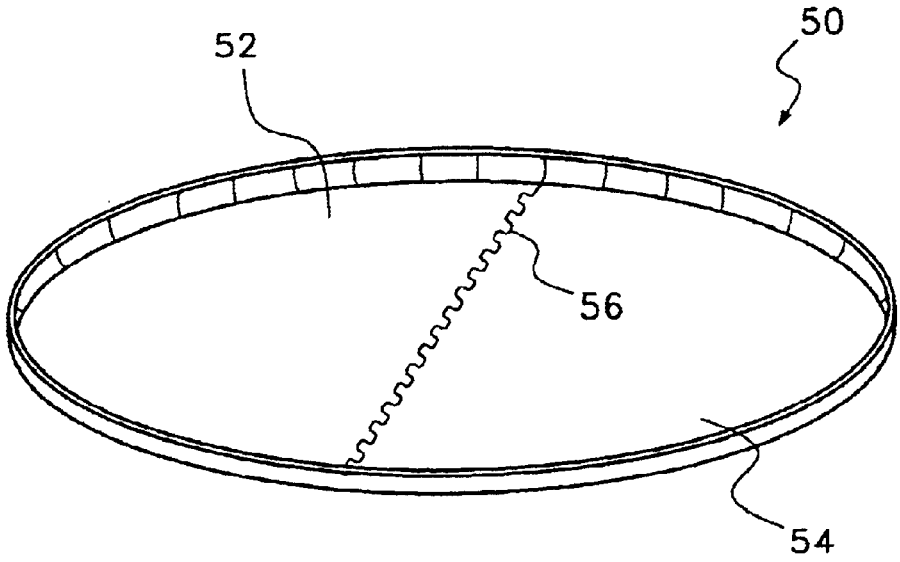
FIG. 5 is a perspective view of an alternate embodiment of a pool liner pad.

The pool liner pad can be rolled up prior to its use. However, depending upon the area of the pool, the pool liner pad may be very heavy if rolled up as a single unit. It should therefore be understood that the pool liner pad can be manufactured in more than one piece. The various pieces can be placed in abutment or interconnected when used. Referring to FIG. 5, a segmented pool liner pad 50 is shown. In this embodiment, the pool liner pad 50 is divided into two semicircles 52, 54. The two semicircles 52, 54 interconnect using a mating dovetailed seam 56. In this manner, the pool liner pad 50 can be more readily stored and transported.

For each of the embodiments of the pool liner pad previously shown, the method used to install the pad is essentially the same. First a pool liner pad is selected that is appropriate in size for an above-ground pool that is to be constructed. The area on which the above-ground pool is to be constructed is prepared in that all sharp sticks, rocks and other protrusions are removed. The pool liner pad is then placed on the ground so that the pool liner pad covers the area of the ground to be occupied by the pool. The continuous vertical wall of the pool is then erected around the pool liner pad. Once the continuous vertical wall is in place, the pool liner is draped over the pool, wherein the liner covers the interior of the continuous vertical wall and lays across the pool liner pad. The pool liner pad is then interposed between the pool liner and the ground surface within said continuous wall. The pool is then ready to be filled with water.

As the water fills the pool, the weight of the water partially compresses the pool liner pad. The presence of the pool liner pad cushions the pool liner, thereby making the pool liner both more comfortable to walk upon and longer lasting.

It will be understood that the embodiments of the present invention pool liner pad that are described and illustrated are merely exemplary and a person skilled in the art can make many variations to the shown embodiments. All such alternate embodiments and modifications are intended to be included within the scope of the present invention as defined below in the claims.

What is claimed is:

1. A method of assembling an above-ground pool on a surface, comprising:

providing an elastomeric pad;

placing said elastomeric pad on said surface, wherein said elastomeric pad creates a padded area on said surface, said elastomeric pad having a central region, a peripheral edge and a peripheral region proximate said peripheral edge, wherein said central region has a uniform thickness and said peripheral region increases in thickness as it approaches said peripheral edge;

erecting a continuous wall around said padded area; and lining said continuous wall and said padded area with a pool liner, wherein said elastomeric pad is interposed between said pool liner and said surface wall.

2. The method according to claim 1, wherein said step of providing an elastomeric pad includes providing an elastomeric pad made from closed cell foam.

3. The method according to claim 1, wherein said step of providing an elastomeric pad includes providing an elastomeric pad that is at least two inches thick in all places.

4. The method according to claim 1, wherein said step of placing said elastomeric pad on said surface includes assembling a plurality of segments of said elastomeric pad to cover said padded area on said surface.

5. A method of preparing an area of ground surface on which will be constructed an above-ground pool that has a pool liner, said method comprising the steps of:

providing prefabricated padding in a plurality of segments;

assembling said plurality of segments of said prefabricated padding on the ground surface into a pad that covers said area on said ground surface, wherein said pad has a central region, a peripheral edge and a peripheral region proximate said peripheral edge, and wherein said central region has a uniform thickness and said peripheral region increases in thickness as it approaches said peripheral edge; and constructing said above-ground pool over said prefabricated padding, wherein said prefabricated padding is interposed between said ground surface and said pool liner, thereby preventing said pool liner from directly contacting said ground surface at any point.

6. The method according to claim 5, wherein said segments of prefabricated padding are made from hydrophobic elastomeric material.

7. The method according to claim 5, wherein said segments of prefabricated padding are at least two inches thick in all places.

8. The method according to claim 5, wherein said elastomeric pad has a central region and a peripheral edge, and further including the step of folding said peripheral edge over toward said central region to double the thickness of said pad proximate said peripheral edge.

* * * * *